US006513198B2

(12) United States Patent
Lu

(10) Patent No.: US 6,513,198 B2
(45) Date of Patent: Feb. 4, 2003

(54) PLASTIC HANDLE STRUCTURE OF A CLAMP TOOL

(75) Inventor: Yu-Jung Lu, Tu Cheng (TW)

(73) Assignee: Hanlong Industrial Co., Ltd., Taipen Hsien (TW)

( * ) Notice: Subject to any disclaimer, the term of this patent is extended or adjusted under 35 U.S.C. 154(b) by 0 days.

(21) Appl. No.: 09/888,423

(22) Filed: Jun. 26, 2001

(65) Prior Publication Data

US 2002/0194706 A1 Dec. 26, 2002

(51) Int. Cl.[7] ..... B25G 1/04; B25G 3/00

(52) U.S. Cl. ..... 16/431; 16/421; 16/DIG. 18; 16/DIG. 19; 81/117.1; 81/427.5; 81/489

(58) Field of Search ..... 16/430, 431, DIG. 12, 16/DIG. 18, DIG. 19, 421; 294/16, 17; 81/177.1, 177.2, 415, 427.5, 489; 264/250, 254, 255, 259, 277.1, 273, 274; 30/340

(56) References Cited

U.S. PATENT DOCUMENTS 5,253,557 A * 10/1993 Dolak ..... 16/430
5,390,572 A * 2/1995 Gakhar et al. ..... 16/430
5,659,959 A * 8/1997 Parlowski ..... 16/430
5,740,586 A * 4/1998 Gomas ..... 16/430
5,781,956 A * 7/1998 Kelsay et al. ..... 15/143.1
6,131,244 A * 10/2000 Bares ..... 16/422
6,134,994 A * 10/2000 Gomas ..... 16/430
6,247,204 B1 * 6/2001 Hamby et al. ..... 16/431
6,270,134 B1 * 8/2001 Lin ..... 16/422

FOREIGN PATENT DOCUMENTS

DE 19539200 A1 * 4/1997
DE 10010674 A1 * 9/2001
EP 0538632 A1 * 4/1993

* cited by examiner

*Primary Examiner*—Chuck Y. Mah
(74) *Attorney, Agent, or Firm*—Bacon & Thomas, PLLC

(57) ABSTRACT

A plastic handle structure of a clamp tool, wherein, a hard plastic layer is provided on the two lateral edge areas of the bottom plate thereof with two lateral edge portions for a fitting-over portion, and the opening of the fitting-over portion per se is provided with two lateral edge portions, the top of the hard plastic layer is cut to open. A transversely directed die block for shaping the fitting-over portion fills soft plastic material in the lateral edge portions for the fitting-over portion, the lateral edge portions of the fitting-over opening and the top cut portion during a soft plastic layer enveloping process, enveloping and filling processes of the soft plastic layer are thus completed, and the structure of the fitting-over portion can be shaped. In the entire operation for the plastic handle, the hard plastic layer can be molded from an upper and a lower die in order to reduce the waiting time to do the enveloping process of the soft plastic layer. Inferior products of hard plastic layers can thus be reduced.

3 Claims, 4 Drawing Sheets

PLASTIC HANDLE STRUCTURE OF A CLAMP TOOL

BACKGROUND OF THE INVENTION

1. Field of the Invention

The present invention is related to a plastic handle structure of a clamp tool, the structure is one which can effectively reduce inferior products, and can reduce waiting time for shaping half-made articles; and especially to a plastic handle structure, wherein, the soft plastic layer can directly become the top structure of the fitting-over members of the plastic handle structure to increase the fitting-over effect of the handles on the legs of the clamp.

2. Description of the Prior Art

As shown in FIG. 1 which shows a clamp tool structure for press connecting a connecting means, wherein, the legs A1 of the clamp tool "A" is provided thereon with plastic handles A2 to increase comfort in holding. The entire structure of each plastic handle A2 is designed to have a hard plastic layer A21 fitting over one of the legs A1 of the clamp tool "A", and a soft plastic layer A22 is applied to cover an area on the hard plastic layer A21 to be touched by user's fingers, thus a firm fitting-over structure of the plastic handle A2 with the leg A1 and a feeling of comfort in holding the clamp tool can be obtained. Therefore, as shown in FIG. 2, during injection molding of a plastic handle A2, the hard plastic layer A21 of the plastic handle A2 is injection molded firstly and then is placed into another injection molding apparatus to proceed forming process of the soft plastic layer A22 over the hard plastic layer A21 itself. Thereby, the entire plastic handle A2 forms the structure as shown in FIG. 3.

By virtue that the plastic handle shall be fitted-over the leg A1 of the clamp tool to cover the latter, as shown in FIG. 2, such a conventional plastic handle A2 is provided in the hard plastic layer A21 thereof with a fitting-over portion A23 for fitting-over the leg A1. Therefore, during injection molding of a plastic handle A2, in addition to an upper and a lower die portion used to form the contour of the hard plastic layer A21, another die block with a transverse motion is required to form the fitting-over portion A23. However, manufacturing of the entire plastic handle A2 shall have the hard plastic layer A21 enveloped with the soft plastic layer A22 after definite completion of shaping of itself, and the time for opening and closing the die portions for adding the die block with a transverse motion during shaping of the hard plastic layer A21 is too long, the subsequent applying of the soft plastic layer A22 shall have to wait for the shaping of the hard plastic layer A21 this long time. This renders working time wasteful. The thickness of the thickness of the hard plastic layer A21 and the fitting-over portion A23 will directly influence the thickness of the soft plastic layer A22, the thinner portion thereof thereby is subjected to resulting of an inferior product due to incomplete injection of the plastic material to render the subsequent enveloping operation of the soft plastic layer A22 failed.

And more, in view that the soft plastic layer A22 of such conventional plastic handle A2 completely envelopes the hard plastic layer A21, the thickness of the hard plastic layer A21 and the fitting-over portion A23 will directly influence the thickness of the soft plastic layer A22 shaped, the thinner portion thereof thereby is subjected to resulting of an inferior product due to incomplete injection of the plastic material to render the subsequent enveloping operation of the soft plastic layer A22 failed. This will make waste of material and working hours.

SUMMARY OF THE INVENTION

In view of the above statement, the plastic handle structure of a clamp tool of the present invention is an improvement on the enveloping structure of the hard plastic layer of the plastic handle with a soft plastic layer. Wherein, primarily, the hard plastic layer is provided on the two lateral edge areas of the bottom plate thereof structurally a with two lateral edge portions for a fitting-over portion, and the opening of the fitting-over portion per se is provided structurally with two lateral edge portions, the top of the hard plastic layer is cut to open. A transversely directed die block for shaping the fitting-over portion fills soft plastic material in the aforementioned two lateral edge portions for the fitting-over portion, the two lateral edge portions of the fitting-over opening and the top cut portion during a plastic layer enveloping process, in this way, the enveloping and the filling processes of the soft plastic layer are completed, and the structure of the fitting-over portion can be shaped. In the entire operation for the plastic handle, the hard plastic layer can be molded from an upper and a lower die in order to reduce the waiting time to do the enveloping process of the soft plastic layer. And this is the primary object of the present invention.

Another object of the plastic handle structure of a clamp tool of the present invention is to provide a structural design of a hard plastic layer which can be molded from an upper and a lower die and can be filled with a soft plastic layer in the top cut portion of the hard plastic layer. In this mode, the soft plastic layer and the hard plastic layer will not have interference in thickness design with each other; inferior products of hard plastic layers can thus be reduced.

Another object of the plastic handle structure of a clamp tool of the present invention is to provide step like portions on the two lateral edge portions for the fitting-over portion, the two lateral edge portions of the fitting-over opening and the rims of the top cut portion to increase the envelopment area between the soft plastic layer and the hard plastic layer, and to provide envelopment grooves for filling the soft plastic layer in the inner sides of the two lateral edge portions for the fitting-over portion and of the bottom plate. These can increase the combining strength between the soft plastic layer and the hard plastic layer.

A further object of the present invention is to render soft plastic layers with more frictional nature to cling to the legs of the clamp tool when the plastic handle is fitted over the clamp tool by making the soft plastic layers the top structure of the top cut portion of the plastic handle, this can increase the effect of fitting-over of the plastic handle on the legs of the clamp tool.

The present invention will be apparent after reading the detailed description of the preferred embodiment thereof in reference to the accompanying drawings.

DETAILED DESCRIPTION OF THE PREFERRED EMBODIMENT

Figure 1:
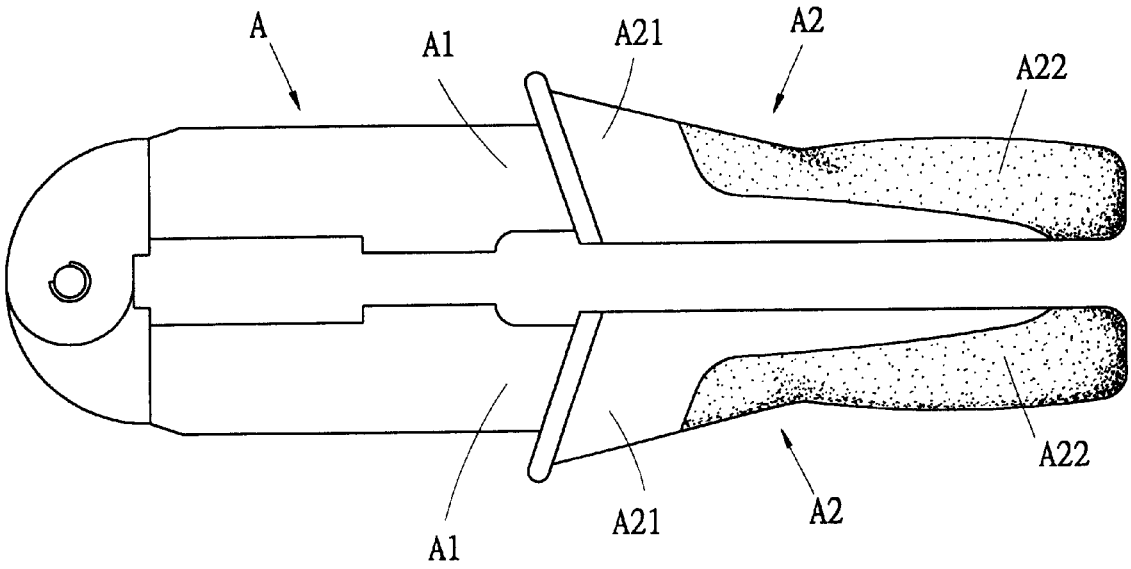
FIG.1 (Prior Art)
FIG. 1 is a schematic view showing the positions of fitting-over of a pair of plastic handles on a conventional clamping tool.
Figure 2:
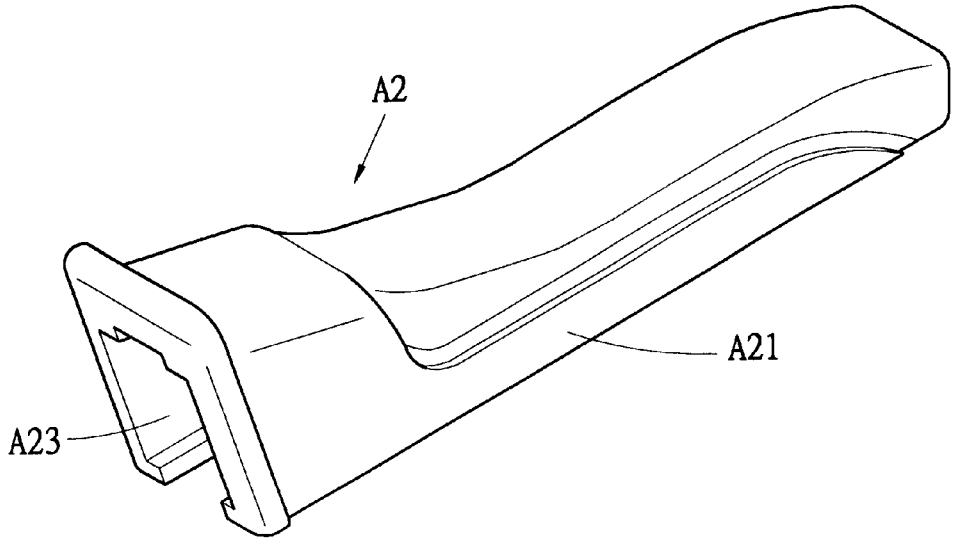
FIG.2 (Prior Art)
FIG. 2 is a perspective view of a hard plastic layer of a plastic handle of the conventional clamping tool.
Figure 3:
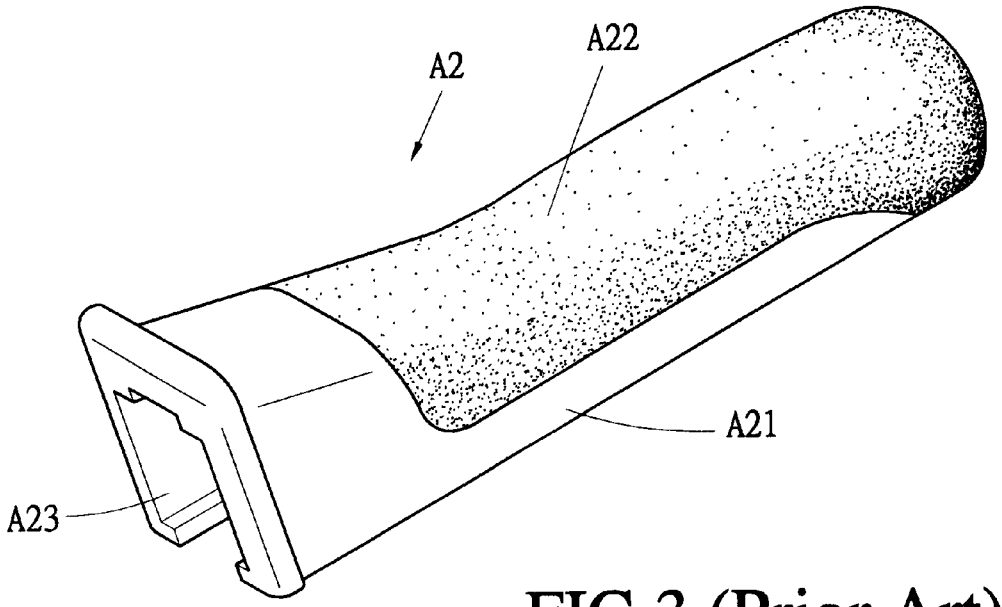
FIG.3 (Prior Art)
FIG. 3 is a perspective view showing the appearance of the conventional plastic handle.
Figure 4:
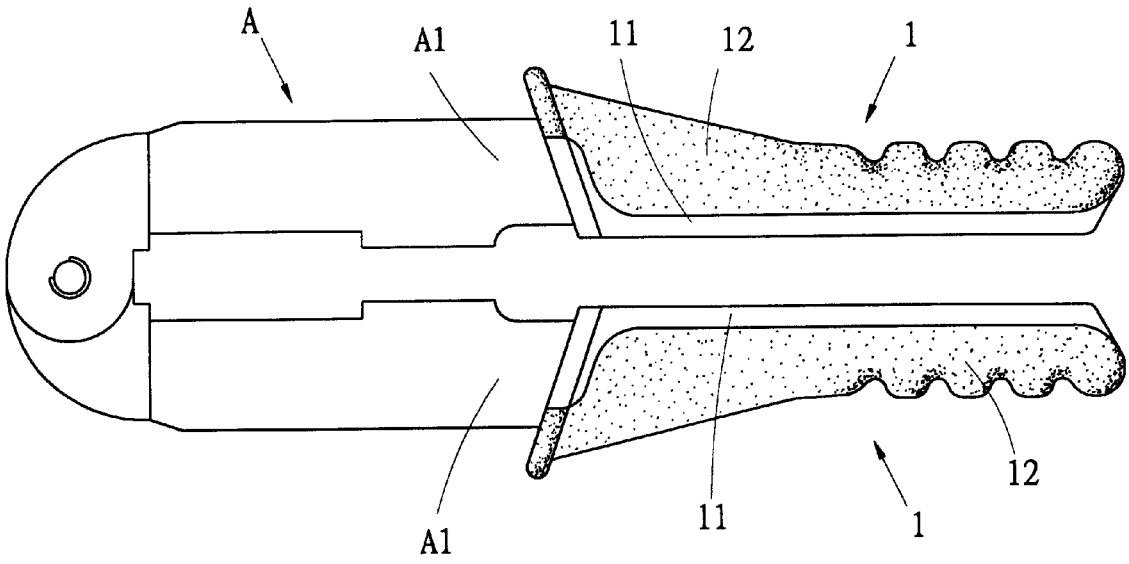
FIG. 4 is a schematic view showing the positions of fitting-over of a pair of plastic handles of the present invention.
Figure 5:
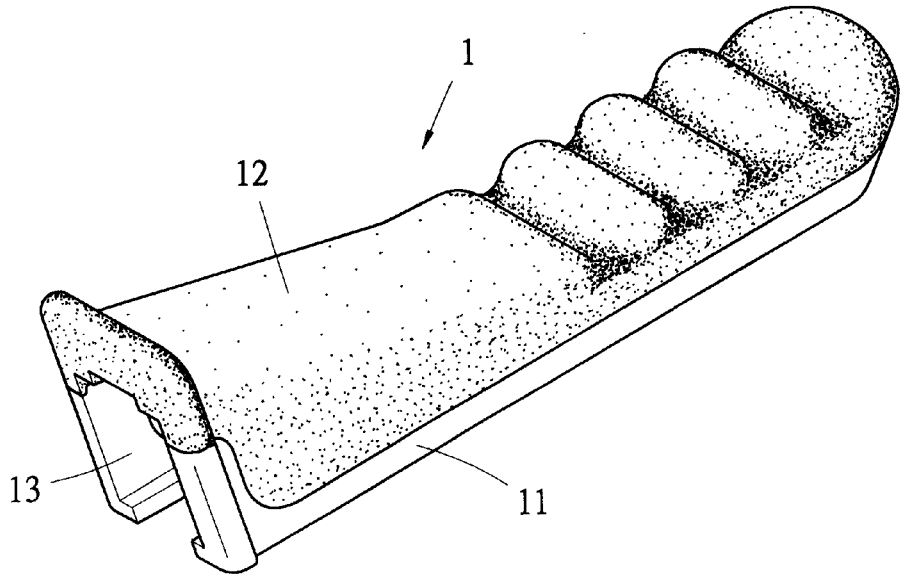
FIG. 5 is a perspective view of a plastic handle of the present invention.

In the plastic handle structure of a clamp tool of the present invention as shown in FIGS. 4 and 5, a plastic handle 1 can be fitted over a leg A1 of a clamping tool "A" to increase comfort when in holding. Wherein, the entire structure of the plastic handle 1 is similarly formed by enveloping of a soft plastic layer 12 over a hard plastic layer 11, and in this structure, a fitting-over portion 13 is formed in order to obtain a firm fitting-over structure on the leg A1 and simultaneously to provide a comfort feeling of holding.

Figure 6:
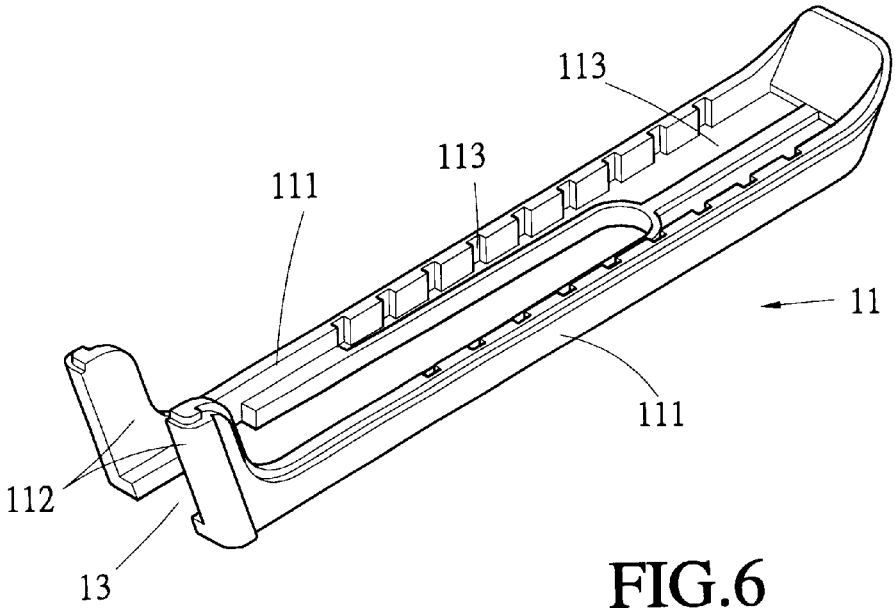
FIG. 6 is a perspective view of a hard plastic layer of the plastic handle of the present invention.
Figure 7:
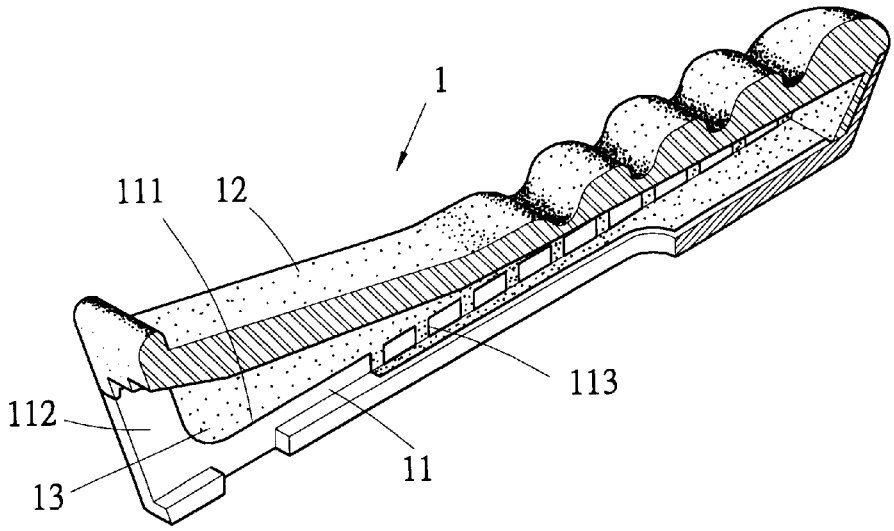
FIG. 7 is a sectional view showing the structure of the plastic handle of the present invention.

Referring also to FIG. 6, the plastic handle structure of a clamp tool of the present invention provides improvement on the envelopment structure of the soft plastic layer 12 over the hard plastic layer 11; and provides primarily a lateral edge structure for a fitting-over portion 13 on the two lateral edges areas of the bottom plate of the hard plastic layer 11, as well as a lateral edge structure of a fitting-over opening of the fitting-over portion 13 proper, and a top cut portion is left on the hard plastic layer 11. And step like portions are provided on two lateral edge portions 111 for the fitting-over portion 13 of the hard plastic layer 11, two lateral edge portions 112 of the fitting-over opening and the rims of the top cut portion; and more, envelopment grooves 113 for filling the soft plastic layer are provided in the inner sides of the two lateral edge portions 111 for the fitting-over portion 13 and of the bottom plate. The hard plastic layer 11 can be molded from an upper and a lower die. An as shown in FIG. 7, after shaping of the hard plastic layer 11, during an enveloping process of the soft plastic layer 12, a transversely directed die block for shaping the fitting-over portion 13 fills soft plastic material in the aforementioned two lateral edge portions 111 for the fitting-over portion 13, the two lateral edge portions 112 of the fitting-over opening and the top cut portion to complete the enveloping process of the soft plastic layer 12 and material filling, and the structure of the fitting-over portion 13 can be shaped. Thereby, in the entire shaping process of the plastic handle 1, the waiting time for shaping of the hard plastic layer 11 to do the enveloping process of the soft plastic layer 12 can be reduced.

As shown in FIGS. 6 and 7, the plastic handle 1 of the present invention has step like portions on the two lateral edge portions 111 for the fitting-over portion 13 of the hard plastic layer 11, the two lateral edge portions 112 of the fitting-over opening and the rims of the top cut portion; and has envelopment grooves 113 for filling the soft plastic layer in the inner sides of the two lateral edge portions 111 for the fitting-over portion 13 and of the bottom plate; these can increase the envelopment area between the soft plastic layer 12 and the hard plastic layer 11, and can increase the combining strength between the soft plastic layer 12 and the hard plastic layer 11. Especially, the structural design of the hard plastic layer 11 molded from an upper and a lower die and filled with a soft plastic layer in the top cut portion thereof saves interference in thickness design of the soft plastic layer 12 with the hard plastic layer 11; and inferior products of hard plastic layers 11 can thus be reduced. And more, the soft plastic layer 12 is directly formed the top structure of the fitting-over portion 13 of the plastic handle 1, so that when the plastic handle 1 is fitted-over a leg A1 of the clamping tool "A", the soft plastic layer 12 with more frictional nature is clung to the leg A1 of the clamping tool "A" to increase the effect of fitting-over of the plastic handle 1 on the leg A1 of the clamp tool "A".

Having now particularly described and ascertained the technical structure of my invention with practicability and improvement and in what manner the same is to be performed.

I claim:

1. A plastic handle structure adapted to fit over a leg of the clamp tool, the plastic handle structure comprising:

a hard plastic layer comprising two parallel lateral edge portions positioned substantially along the longitudinal length of the hard plastic layer, a pair of upwardly extending edge portions, each extending from an open end of respective ones of the lateral edge portions, the spacing between the lateral edge portions forming a fitting-over portion, the hard plastic layer further comprising a plurality of envelopment grooves positioned on an inner wall of the lateral edge portions, and further envelopment grooves formed on the hard plastic layer between the lateral edge portions;

the fitting-over portion of the hard plastic layer is adapted to receive a leg of a clamping tool; and a soft plastic layer attached to the edge portions of the hard plastic layer, the soft plastic layer attached to the envelopment grooves, and the soft plastic layer adapted to be adhered to a leg of a clamp tool.

2. The plastic handle structure as claimed in claim 1, wherein the lateral edge portions of the hard plastic layer further comprises step-like portions adapted for outlining the fitting-over portion of the hard plastic layer.

3. The plastic handle structure as claimed in claim 1, wherein the hard plastic layer is adapted to be molded form upper and lower dies, and the fitting-over portion is adapted to be formed by a die block that fills soft plastic material in the inner wall of the lateral edge portions.

* * * * *